US006641090B2

(12) United States Patent
Meyer

(10) Patent No.: US 6,641,090 B2
(45) Date of Patent: Nov. 4, 2003

(54) TRAIN LOCATION SYSTEM AND METHOD

(75) Inventor: Thomas J. Meyer, Marilla, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/041,744

(22) Filed: Jan. 10, 2002

(65) Prior Publication Data

US 2002/0088904 A1 Jul. 11, 2002

Related U.S. Application Data

(60) Provisional application No. 60/260,525, filed on Jan. 10, 2001.

(51) Int. Cl.[7] ..... G01S 9/56

(52) U.S. Cl. ..... 246/122 R; 246/167 R; 701/19; 364/449

(58) Field of Search ..... 701/19, 20, 213, 701/214, 216, 217, 220, 221; 246/122 R, 124, 167 R, 187 A, 126, 121; 364/449, 453; 342/450

(56) References Cited

U.S. PATENT DOCUMENTS

| | | | | |
|---|---|---|---|---|
| 3,739,383 A | | 6/1973 | Perot et al. | |
| 3,757,112 A | | 9/1973 | Lehmann | |
| 3,888,437 A | | 6/1975 | Birkin | |
| 4,027,840 A | | 6/1977 | Blair | |
| 4,028,531 A | | 6/1977 | Cottin et al. | |
| 4,106,094 A | | 8/1978 | Land | |
| 4,556,940 A | | 12/1985 | Katoo et al. | |
| 4,611,775 A | * | 9/1986 | Petit | 246/28 F |
| 4,713,767 A | | 12/1987 | Sato et al. | |
| 4,763,267 A | * | 8/1988 | Knight et al. | 701/117 |
| 4,768,740 A | | 9/1988 | Corrie | |
| 4,864,306 A | | 9/1989 | Wiita | |
| 4,899,285 A | | 2/1990 | Nakayama et al. | |
| 5,012,424 A | | 4/1991 | Dodson | |
| 5,067,083 A | | 11/1991 | Nakayama et al. | |
| 5,177,685 A | | 1/1993 | Davis et al. | |
| 5,184,304 A | | 2/1993 | Huddle | |
| 5,332,180 A | | 7/1994 | Peterson et al. | |
| 5,902,351 A | * | 5/1999 | Streit et al. | 701/220 |
| 5,912,643 A | * | 6/1999 | Chew et al. | 342/457 |
| 5,928,309 A | * | 7/1999 | Korver et al. | 701/214 |
| 6,127,970 A | * | 10/2000 | Lin | 342/357.14 |
| 6,128,558 A | * | 10/2000 | Kernwein | 701/19 |
| 6,157,891 A | * | 12/2000 | Lin | 701/301 |
| 6,218,961 B1 | * | 4/2001 | Gross et al. | 340/903 |
| 6,246,960 B1 | * | 6/2001 | Lin | 701/214 |
| 6,308,134 B1 | * | 10/2001 | Croyle et al. | 701/220 |
| 6,434,452 B1 | * | 8/2002 | Gray | 701/19 |

FOREIGN PATENT DOCUMENTS

| | | |
|---|---|---|
| DE | P 21 24 089.1 | 7/1972 |
| DE | P 22 22 266.8 | 11/1973 |

* cited by examiner

*Primary Examiner*—S. Joseph Morano
*Assistant Examiner*—Frantz Jules
(74) *Attorney, Agent, or Firm*—Wallace G. Walter

(57) ABSTRACT

A train location system and method of determining track occupancy utilizes inertial measurement inputs, including orthogonal acceleration inputs and turn rate information, in combination with wheel-mounted tachometer information and GPS/DGPS position fixes to provide processed outputs indicative of track occupancy, position, direction of travel, velocity, etc. Various navigation solutions are combined together to provide the desired information outputs using an optimal estimator designed specifically for rail applications and subjected to motion constraints reflecting the physical motion limitations of a locomotive. The system utilizes geo-reconciliation to minimize errors and solutions that identify track occupancy when traveling through a turnout.

9 Claims, 10 Drawing Sheets

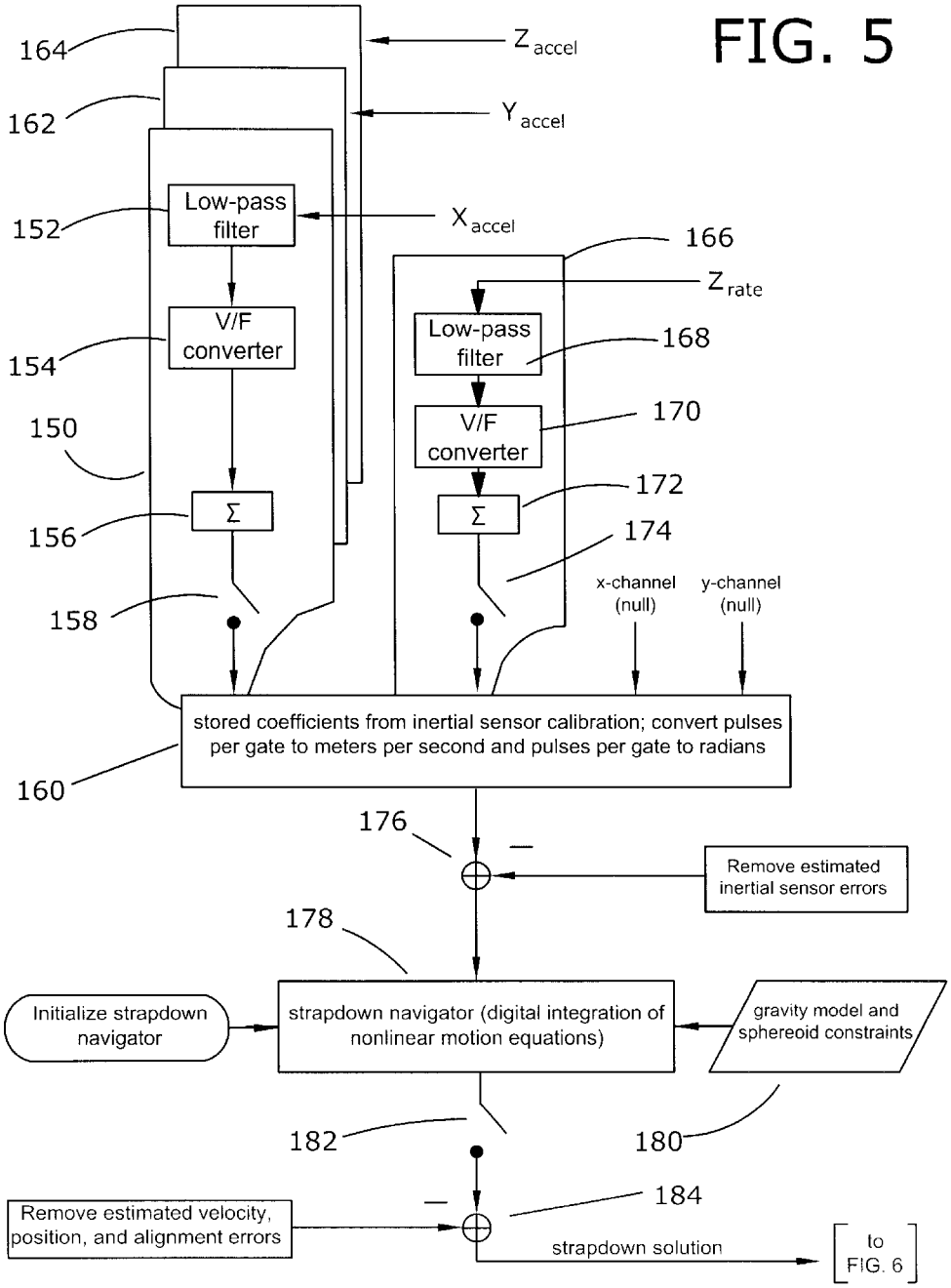
FIG. 5
164
162
152
154
150
156
158
160
166
168
170
172
174
176
178
180
182
184
Z accel
Y accel
X accel
Z rate
Low-pass filter
V/F converter
Σ
Low-pass filter
V/F converter
Σ
x-channel (null)
y-channel (null)
stored coefficients from inertial sensor calibration; convert pulses per gate to meters per second and pulses per gate to radians
Remove estimated inertial sensor errors
Initialize strapdown navigator
strapdown navigator (digital integration of nonlinear motion equations)
gravity model and sphereoid constraints
Remove estimated velocity, position, and alignment errors
strapdown solution
to FIG. 6

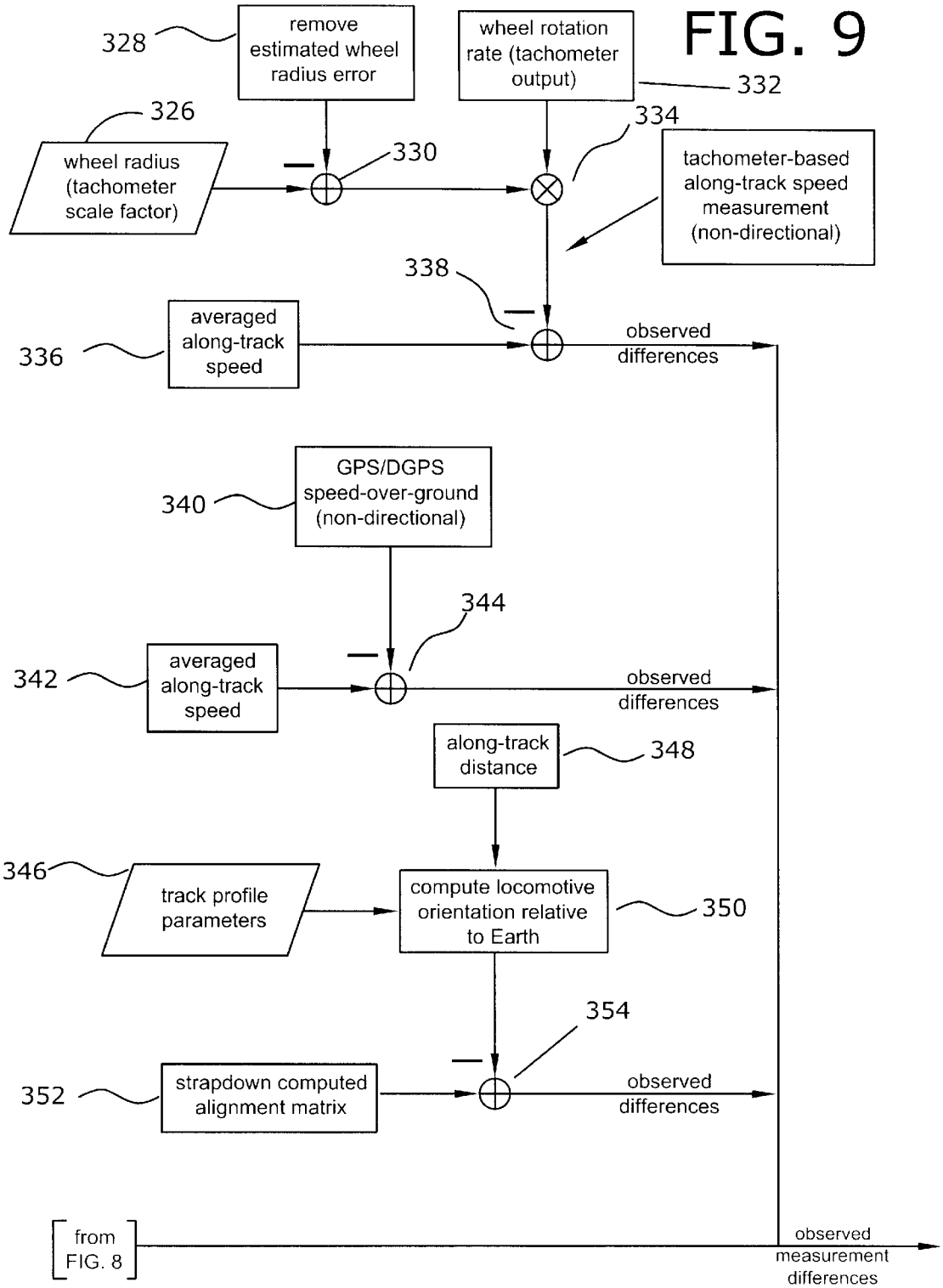
FIG. 9
328
remove estimated wheel radius error
wheel rotation rate (tachometer output)
332
326
wheel radius (tachometer scale factor)
330
334
tachometer-based along-track speed measurement (non-directional)
338
336
averaged along-track speed
observed differences
340
GPS/DGPS speed-over-ground (non-directional)
344
342
averaged along-track speed
observed differences
along-track distance
348
346
track profile parameters
compute locomotive orientation relative to Earth
350
354
352
strapdown computed alignment matrix
observed differences
from FIG. 8
observed measurement differences

TRAIN LOCATION SYSTEM AND METHOD

CROSS REFERENCE TO PROVISIONAL PATENT APPLICATION

This application claims the benefit of the filing date of U.S. Provisional Patent Application No. 60/260,525 filed Jan. 10, 2001 by the applicant herein, the disclosure of which is incorporated herein by reference.

BACKGROUND OF THE INVENTION

The present invention relates to train location systems and, more particularly, to train location systems for continuously and accurately identifying the location of a train on or within a trackway system using a train-mounted geo-positional receiver system and inertial sensors in combination with other signals provided from one or more train-mounted sensors.

Various systems have been developed to track the movement of and location of railway trains on track systems.

In its simplest form, train position can be ascertained at a central control facility by using information provided by the crew, i.e., the train crew periodically radios the train position to the central control facility; this technique diverts the attention of the crew while reporting the train position, often requires several "retries" where the radio link is intermittent, and the position information rapidly ages.

Early efforts have involved trackside equipment to provide an indication of the location of a train in a trackway system. Wayside devices can include, for example, various types of electrical circuit completion switches/systems by which an electrical circuit is completed in response to the passage of a train. Since circuit completion switches/system are typically separated by several miles, this technique provides a relatively coarse, discrete resolution that is generally updated or necessarily supplemented by voice reports by the crew over the radio link.

In addition, information from one or more wheel tachometers or odometers can be used in combination with timing information to provide distance traveled from a known start or waypoint position. Since tachometer output can be quite "noisy" from a signal processing standpoint and accuracy is a function of the presence or absence of wheel slip, the accuracy of the wheel-based distanced-traveled information can vary and is often sub-optimal.

Other and more sophisticated trackside arrangements include "beacons" that transmit radio frequency signals to a train-mounted receiver that can triangulate among several beacons to determine location.

While trackside beacon systems have historically functioned in accordance with their intended purpose, trackside systems can be expensive to install and maintain. Trackside systems tend not to be used on a continent-wide or nationwide basis, leaving areas of the track system without position-locating functionality (viz., "dark" territory).

More recently, global navigation satellite systems such as the Global Positioning System (GPS) and the nationwide Differential GPS (NDGPS), have been used to provide location information for various types of moving vehicles, including trains, cargo trucks, and passenger vehicles. GPS and similar systems use timed signals from a plurality of orbital satellites to provide position information, and, additionally, provide accurate time information. The time information can include a highly accurate 1PPS (1-pulse-per-second) output that can be used, for example, to synchronize (or re-synchronize) equipment used in conjunction with the GPS receiver. The GPS/DGPS receivers require a certain amount of time to acquire the available satellite signals to calculate a positional fix. While the GPS system can be used to provide position information, GPS receivers do not function in tunnels, often do not function well where tracks are laid in steep valleys, and can fail to operate or operate intermittently in areas with substantial electromagnetic interference (EMI) and radio frequency interference (RFI). When a GPS system is operated on a fast-moving vehicle, the location information becomes quickly outdated. In addition, the accuracy of the GPS system for non-military applications is such that track occupancy (which track a train is on among two or more closely spaced tracks) cannot be determined consistently and reliably.

Current philosophy in train systems is directed toward higher speed trains and optimum track utilization. Such train systems require ever more resolution in train location and near real-time or real time position, distance from a known reference point, speed, and direction information. In addition to locating a train traveling along a particular trackway to a resolution of one or two meters, any train location system should be able to locate a train along one of several closely spaced, parallel tracks. Since track-to-track spacing can be as little as three meters, any train location system must be able to account for train location on any one of a plurality of adjacent trackways or determine track occupancy at a turnout or other branch point.

SUMMARY OF THE INVENTION

In view of the above, it is an object of the present invention, among others, to provide a train location system and method that utilizes geo-reconciliation to improve system performance.

It is another object of the present invention to provide a train location system and method that solve the track occupancy problem when a train passes through a turnout onto one of two or more tracks leading from the turnout.

The present invention provides a train location system that utilizes inertially sensed orthogonal acceleration inputs and turn-rate information combined with other inputs, such as those provided by one or more wheel-mounted tachometers and pre-stored or downloaded-on-the-fly track signature profiles, to provide information inputs related to velocity and location. In addition, GPS/DGPS information is used to provide processed outputs indicative of position and related variables.

The present invention blends a plurality of navigation solutions (i.e., three) together to provide the desired information outputs. The three solutions possess complimentary error characteristics and are used in conjunction with exogenous data in an optimal estimator designed (i.e., tuned) specifically for rail applications and subjected to motion constraints reflecting the physical motion limitations of a locomotive. The complimentary nature of the error mechanisms involved enables the desired variables, viz., position, speed, etc., to be uniquely observed mathematically and thence computed.

The present invention incorporates the concept of geo-reconciliation by which information vectors from sources having different error characteristics are geo-reconciled to reduce the adverse affect of short- and long-term errors. In the context of the velocity vector, for example, an inertially derived velocity vector is geo-reconciled with a geo-computed velocity vector obtained, for example, from the calibrated wheel tachometer and the train forward axis or track centerline axis. In general, the inertially obtained and the tachometer derived velocity vectors will be different based upon the cumulative errors in each system. An optimal estimator functions to blend two such values to obtain the geo-reconciled velocity vector. With each successive computation sequence, the optimal estimator functions to estimate the error mechanisms and effect corrections to successively propagate position and the associated uncertainty along the track.

Fault detection logic is used to correctly maintain track occupancy at branch points. A solution is computed along each of the two diverging tracks when passing through a turnout. Forcing the solution to propagate along the would-be incorrect track subsequently shapes estimated error states in a distinguishable manner and does so with adequate diversity to make the track occupancy decision with sufficient confidence.

An optimal estimator, preferably in the form of a Kalman filter, extended Kalman filter or variants thereof, is provided with state equations that define estimated position in response to the various information inputs, measurements, and signals. The use of an optimal estimator allows continuous high-veracity position information outputs, including position information outputs under conditions in which the input information is noisy, momentarily interrupted, and/or otherwise sub-optimal.

Additionally, the present invention drives the average lateral and vertical velocity to null and the cross-track velocity to null as an effective way of enforcing the physical constraints of locomotion.

Position information from a plurality of trains can be provided to a central track control or command center to allow more efficient utilization of the train/track system.

Other objects and further scope of applicability of the present invention will become apparent from the detailed description to follow, taken in conjunction with the accompanying drawings, in which like parts are designated by like reference characters.

BRIEF DESCRIPTION OF THE DRAWING

FIGS. 5 and 6 represent a process flow diagram showing the manner by which the data is processed;

FIGS. 8 and 9 illustrate a process flow diagram of the treatment of the measurement differences for the various inputs and also illustrates the combined contributions of the inertial and GPS/DGPS inputs.

DESCRIPTION OF THE PREFERRED EMBODIMENT

Figure 1:
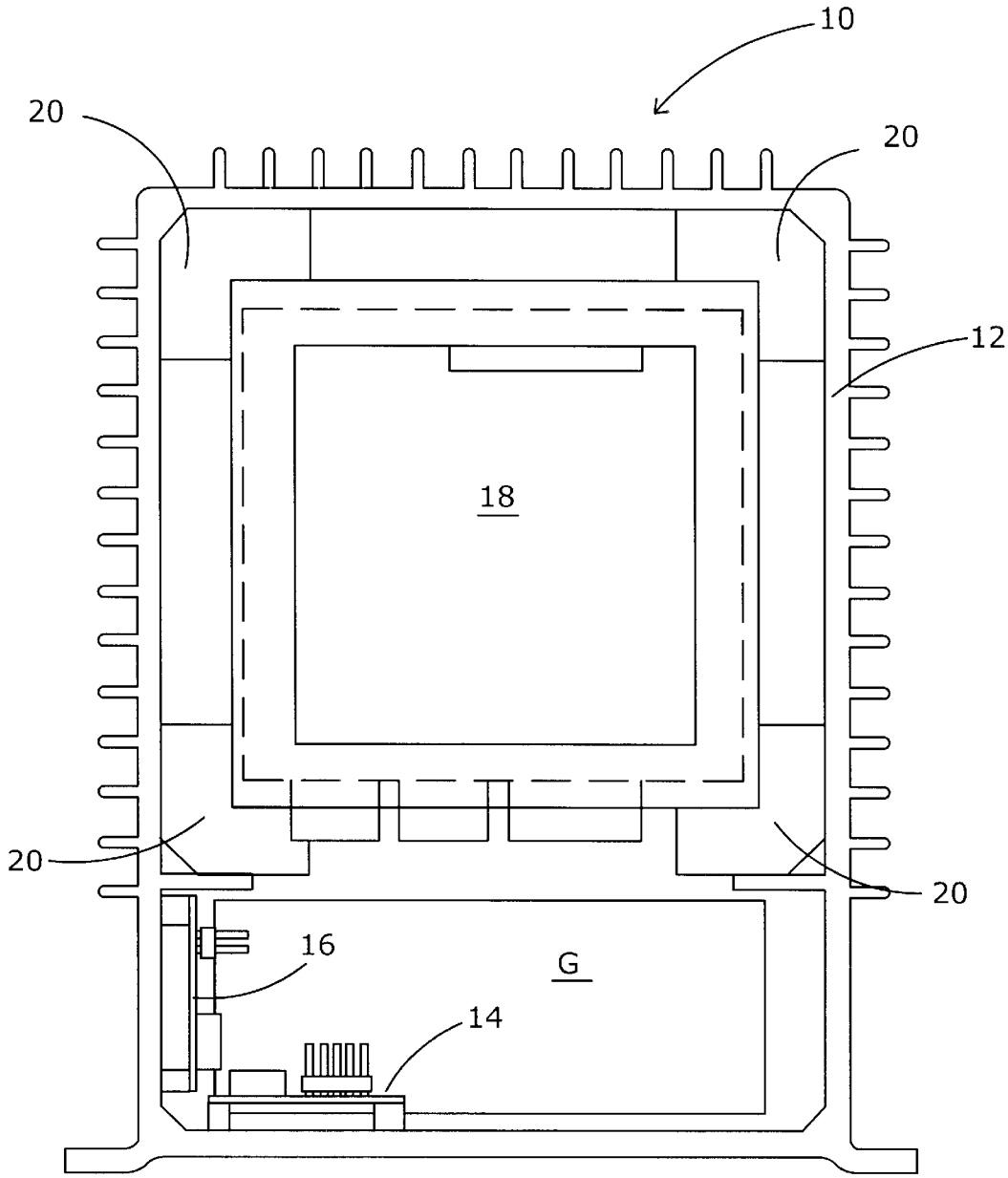
FIG. 1 is a representative elevational view of a location determination module in accordance with the present invention.

A train location determination system (LDS) in accordance with the present invention is shown in a generalized physical form in FIG. 1 and designated generally therein by the reference character 10. The physical presentation of FIG. 1 is merely representative of the various ways in which a location determining system in accordance with the present invention can be configured. As shown, the location determining system 10 includes a generally vertically aligned housing 12 that includes a rate gyro G, a first accelerometer board 14 and an orthogonally aligned second accelerometer board 16. The various boards and devices are interconnected by various cables and connectors (not specifically shown). As explained below, the rate gyro G and the first accelerometer board 14 and the second accelerometer board 16 provide, respectively, rate of turn and three-axis acceleration information to the processing electronics (as explained below).

A set of circuit card assemblies 18 is mounted in the upper portion of the housing 12; the circuit card assemblies 18 effects signal conditioning and processing as explained below. In the preferred embodiment, the circuit cards conform to the PC/104 standard which provides for interconnectable circuit cards that use common PC bus communications protocols within a standard form-factor; as can be appreciated, the processing electronics can use other industry standard or proprietary protocols. The circuit card assemblies 18 are partially isolated from ambient vibration by elastomeric vibration isolators 20.

The rate gyro G is preferably a commercially available fiber optic gyro (FOG) that can include integrated electronics and which provides turn rate information as an output. Although a fiber optic gyro is preferred because of its ability to operate in harsh environments, other turn rates devices, including conventional rotating mass gyroscopes, ring-laser gyroscopes, and microelectronic turn rate indicator are not excluded.

The accelerometers are preferably of the microelectronic type in which a pendulum is etched from a silicon substrate between conductive capacitor plates; acceleration-induced forces on the pendulum cause changes in the relative capacitance value; an integrated restoring loop (or equivalent) provides an indication of the acceleration being experienced along the sensing axis. While microelectronic devices are preferred, conventional pendulum type accelerometers, with or without restoring loops, are not excluded from the present invention.

The first accelerometer board 14 includes a sufficient number of devices to provide acceleration information along the direction of travel axis (i.e., X axis) and along the a side-to-side lateral axis (i.e., Y axis). In a similar manner, the second accelerometer board 16 provides acceleration information in the up-down vertical axis (i.e., Z-axis). If desired, redundant accelerometers can be provided on one or more axes to impart an added measure of reliability to the system. Thus, the various accelerometers provide respective $X_{accel}$, $Y_{accel}$, and $Z_{accel}$ information.

As can be appreciated, the housing 12 is secured to a mount within a portion of the train (i.e., the locomotive) in such a way that the various sensing axes are appropriately aligned with the locomotive longitudinal (i.e. direction of travel), lateral, and vertical coordinates.

The location determining system 10 communicates with other devices in the locomotive using a network interface. Modern locomotive have an on-board network for interconnection with various devices and an on-board computer (not specifically shown). A suitable and preferred network interface conforms to the LonWorks standard, although other network protocols, such as the Ethernet standard (and its variants), are suitable.

Figure 2:
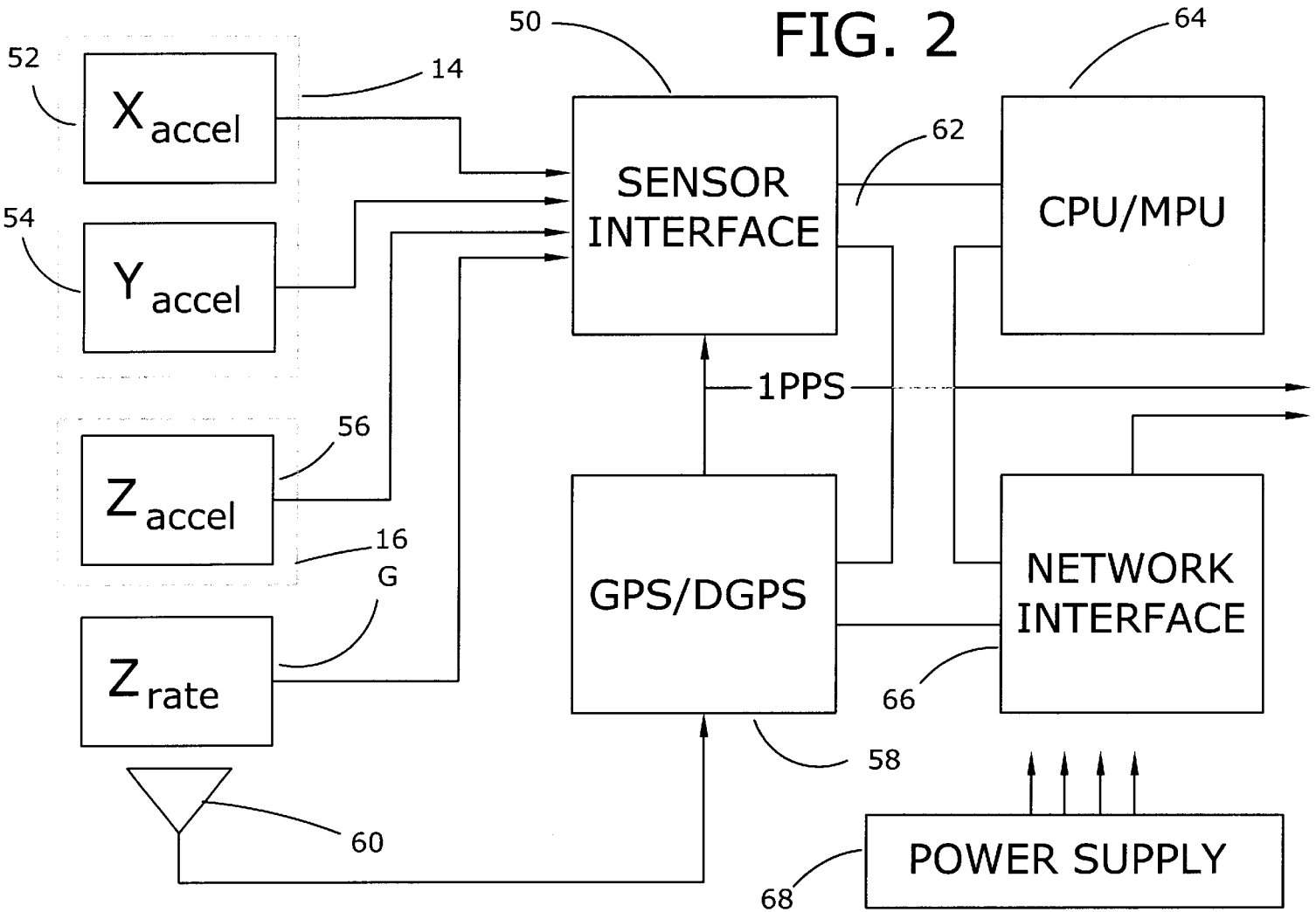
FIG. 2 a schematic block diagram of the major functional components of the preferred embodiment.

The location determining system 10 is functionally organized as shown in block form in FIG. 2. As shown, a sensor interface 50 accepts the $X_{accel}$ and $Y_{accel}$ outputs from accelerometers 52 and 54 (mounted on the first accelerometer board 14), the $Z_{accel}$ output from an accelerometer 56 (mounted on the second accelerometer board 16), and the rate gyro G.

A GPS receiver 58, including a low-profile locomotive roof-mounted antenna 60, also provides an input to the sensor interface 50 via its 1PPS output. The GPS receiver 58 can also take the form of a commercial chipset that includes both GPS and a DGPS receiver function and is preferably mounted on one of the circuit cards of the circuit card assembly 18 (FIG. 1). The sensor interface 50 and the GPS receiver 58 communicate bi-directionally over a bus 62 with a processing unit 64 and a network interface 66 that interfaces with the locomotive network to provide periodic position reports. A power supply 68 provides appropriately conditioned power voltages to the various devices.

In FIG. 2, processing is shown as taking place in the processing unit 64; as can be appreciated, all or part of the processing (as described in FIG. 3) can take place in the processing unit 64, the on-board computer of the locomotive (not shown), or sub-portions of the processing can be effected in distributed stored-program microprocessors or specifically configured application specific integrated circuits (ASICS). In addition, data can be stored in and/or retrieved from various memory devices including traditional hard disc storage, various types of static RAM (SRAM), or dynamic RAM (DRAM).

Figure 3:
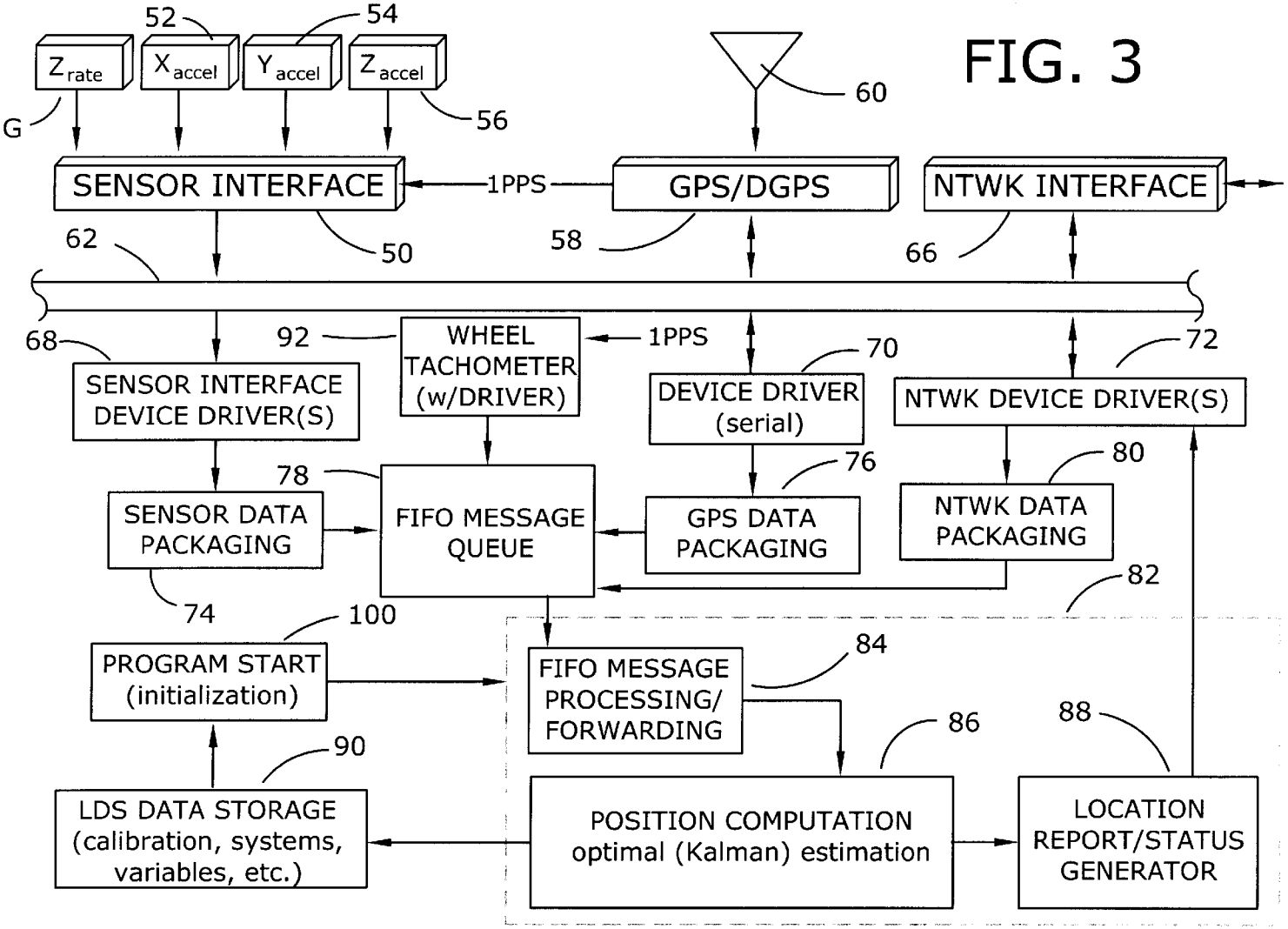
FIG. 3 is a block diagram showing the interfacing of the hardware components and the software-implemented components of the preferred embodiment.

The processing organization of the location determining system 10 and its interface with the functional organization of FIG. 2 is shown in schematic form in FIG. 3. As shown, the bus 62 functions to interconnect the rate gyro G and the accelerometers 52, 54, and 56 through the sensor interface 50 with the GPS receiver 58 and the network interface 66.

A sensor interface device driver 68, a GPS device driver 70, and a network device driver 72 interconnect with and through the bus 62; the drivers 68 and 70 condition their respective signals for subsequent processing.

The output of the sensor interface device diver 68 is provided to a sensor data packager 74 and the output of the device driver 70 is provided to a GPS data packager 76 with their respective outputs provided to a first-in first out (FIFO) message queue 78. In a similar manner, the network device driver 72 outputs to a network data packager 80, which, in turn, outputs to the FIFO message queue 78. The various device drivers function to condition the output signals for a common data packaging protocol and are specific to the operating system used. For example, where the QNX embedded operating system is used, the various drivers conform to the QNX protocol.

The output of the locomotive wheel tachometer is conditioned and processed through a wheel tachometer block 92 and likewise provided to the FIFO message queue 78.

A main process module 82 (dotted line illustration) includes a FIFO message processor 84 that forwards the packaged messages from the sensor functions, the GPS receiver functions, and the network into a position computation functional block 86. The position computation functional block 86, as explained more fully below, outputs position on a continuous, near-continuous, or periodic basis to a location report/status generator 88 and to a data storage unit 90. As mentioned above, the data storage function can be localized in one data storage unit or can be distributed across a number of data storage units of various types.

The output of the location reports/status generator 88 is provided through the network device driver 72 through the bus 62 to the network interface 66 that connects for the locomotive on-board computer (which may share some or all of the processing of FIG. 3) for on-board display and communication (via a RF link) to one or more train control centers. In general, the location reports preferably includes track occupancy, location along occupied track from known reference point, speed, direction of travel, a stopped/not-stopped indication, an estimated accuracy of these outputted parameters, an indication of the information used to compute the location solution, a conventional Built-in-Test (BIT) status indicator, and a validity flag that indicates whether or not the solution and its reported accuracy is valid (i.e., the 'reasonableness' of the solution).

A program start functional block 100 connects to the data storage unit 100 and to the main process module 82 to start the overall processing sequence.

Position computation in the main process module 82 is effected through an optimal estimator in the form of a Kalman filter, and extended Kalman filter (EKF), and variants thereof. Kalman optimal estimation involves a set of state equations that linearly model the physical characteristics of the system and sequentially process the sensor and GPS information regardless of their precision and which outputs a 'state' estimate with a minimum or near-minimum of statistical errors from measurement errors, noise, bias, and other uncertainties/errors.

The location determining system 10 uses the discrete set of parameters mentioned above to reconstruct a continuous model of the track profile in the general vicinity of the train. Various parameters, including the track 'signature' profile in the vicinity of the train can be pre-stored in memory or downloaded-on-the-fly.

The inertial sensors, i.e., the rate gyro R and the three accelerometers (53, 54, 56), send data during recurring 'gate' periods (about 200 Hz) to the FIFO message queue 78 and, substantially concurrently, the GPS/DGPS position fixes are likewise sent to the FIFO message queue 78 at the 1PPS rate during the time that sufficient satellites are visible. Lastly, wheel tachometer 92 data is also sent to the FIFO message queue 78 at a 1 Hz rate (as clocked by the 1PPS signal.)

The main process module fuses the three inertial navigation solutions together, aided by the exogenous GPS/DGPS receiver data and the tachometer data in the position computation (Kalman) optimal estimator 86.

The three navigation solutions are (a) conventional strapdown navigation solution using the single Z-axis gyro and nulled x- and y-channels (pitch and roll axes of the locomotive experience very little pitch and roll variation aside from vibration), (b) a projection of the inertial data is projected along the occupied track profile reconstructed from parameters on the fly, and then integrated appropriately for position, speed, etc., and (c) projection of the inertial data along the locomotive (cab) fixed reference axes and then appropriately integrated for location.

The three navigation solutions are optimally blended with the external GPS/DGPS receiver 58 and the tachometer data 92, and the solution is subjected to motion constraints reflecting the physical limitations of how a locomotive can move.

Fault detection logic is used to correctly maintain track occupancy at branch points; a solution is computed along each of the two diverging tracks at a turnout. Forcing the solution to propagate along the incorrect track subsequently yields step and ramp changes in estimated error mechanisms. These signals are strong enough and sufficiently diverse to make the track-occupancy-at-diverging-tracks decisions with confidence and in a timely manner.

Figure 4:
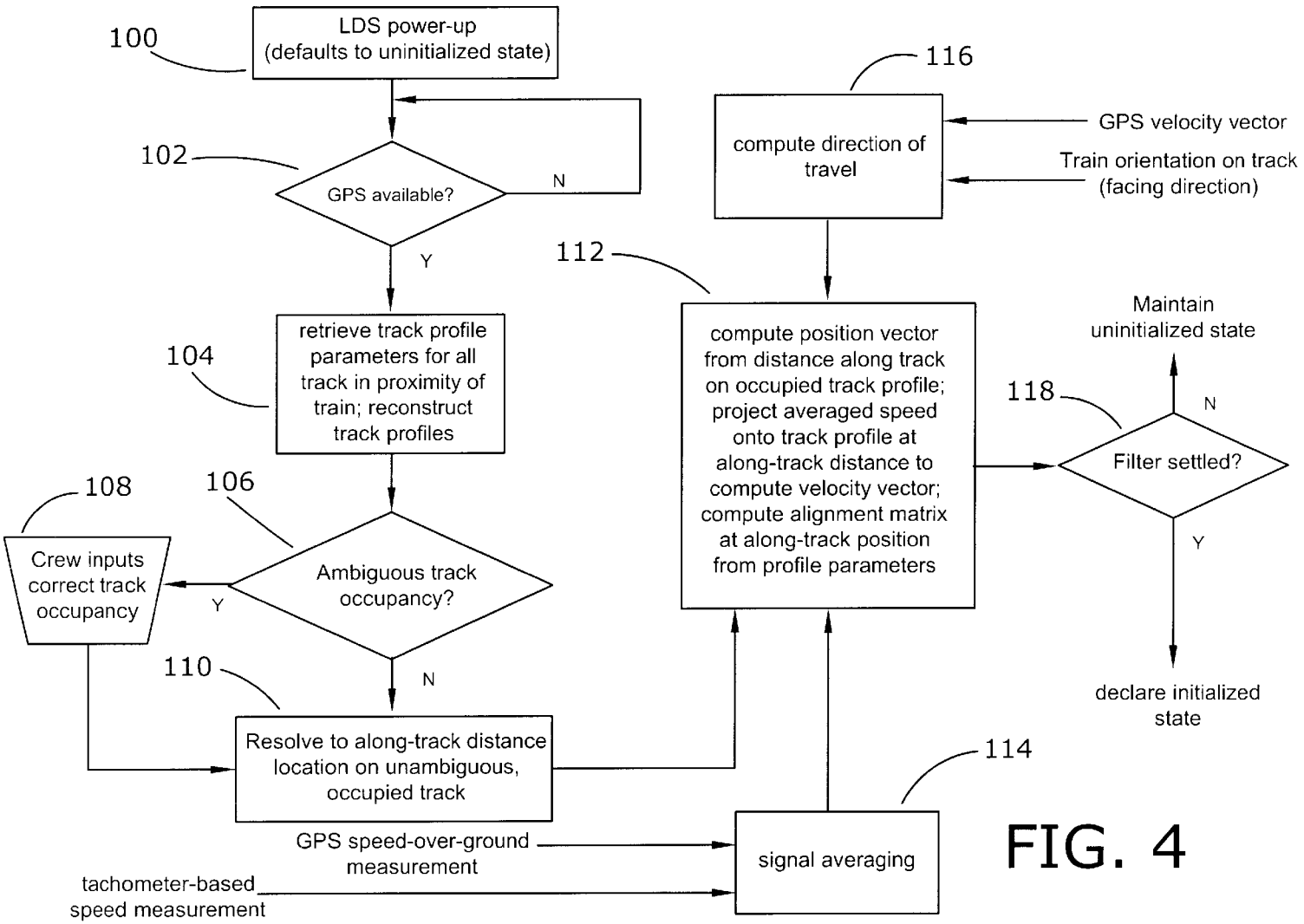
FIG. 4 is a simplied flow diagram illustrating the power-up/initialization sequence of the system of the present invention.

FIG. 4 is a simplied flow diagram illustrating the power-up/initialization sequence of the LDS 10; post start-up processing is described in subsequent figures.

As shown in FIG. 4, the system is powered-up at block 100 with the system defaulting to an uninitialized state. A query is presented at decision point 102 as to whether or not the GPS output is available. If the GPS output is not available, the process loops until such time that the GPS output is available.

Thereafter and at block 104, the track profile of all the train in the vicinity of the train is retrieve to construct a track profile(s). As mentioned above, the track profile can be pre-stored in memory or downloaded as needed.

A query is then presented at decision point 106 to determine whether or not an ambiguous track occupancy condition exists (i.e., which track is occupied among two or more closely adjacent tracks). If an ambiguous track occupancy condition exists, the crew inputs the correct track occupancy value.

Thereafter, the along track distance is determined in block 110 and that along track distance value is supplied to the optimal estimator 112. In addition, a signal averaging functional block 114 accepts a GPS speed-overground value and a wheel tachometer-based value, performs an averaging value in the functional block 114, and outputs an average along-track speed value to the optimal estimator 112. As shown in the upper part of FIG. 4, direction of travel function block 116 accepts the GPS velocity vector and a train orientation on the occupied track value to compute a direction of travel value that is presented to the optimal estimator 112.

The optimal estimator 112 sequentially processes the input values to converge toward a solution for the position vector and the velocity vector and an alignment matrix from the track profile parameters. At some point in the processing, a query is presented at decision point 118 as to whether or not the optimal estimator 112 has settled (i.e., converged to a optimal estimate). If the optimal estimator 112 is deemed to have successfully 'settled', the system is declared 'initialized'; otherwise the system is maintained in its initial default uninitialized state.

Figure 6:
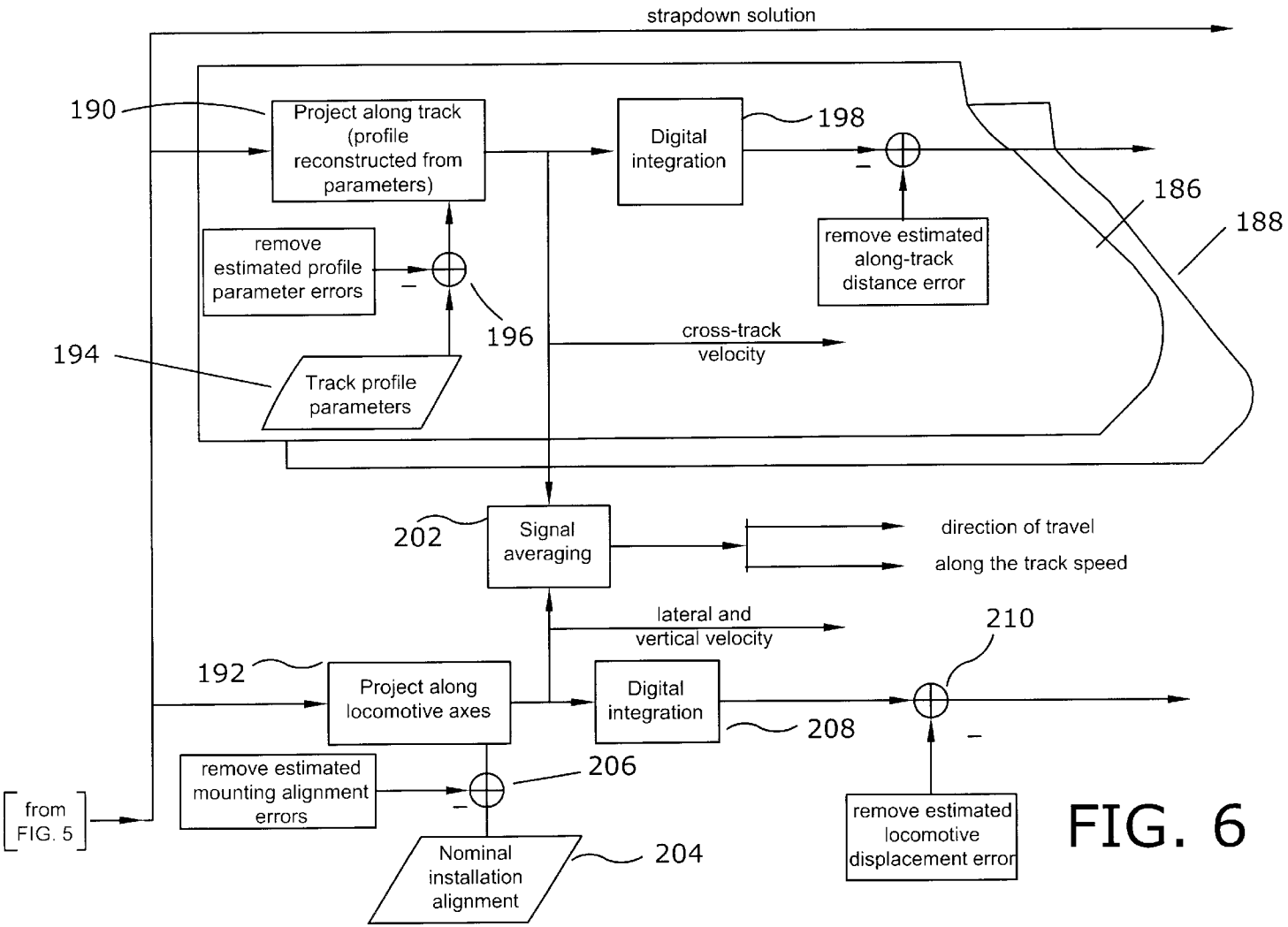

Post-initialization process flow is shown in FIGS. 5 and 6. As shown in FIG. 5, the X direction acceleration (along the side-to-side or lateral direction) is addressed in process 150. The $X_{accel}$ value, i.e., a hardware-provided analog voltage that is proportional to the sensed acceleration, is input to a low-pass filter 152; the low-pass filter eliminates frequencies beyond the motion of interest. The filtered voltage is then supplied to a voltage-to-frequency converter 154 that outputs a pulse stream, the frequency of which is proportional to input voltage (and the sensed acceleration). The pulse stream is then summed in an accumulator 156 over recurring fixed count periods. The output of the accumulator 156 is then gated and reset at 158 (the pulse count is proportional to integrated voltage, i.e., the velocity increment) and provided to a scale factor/units conversion function block 160 that changes the gated pulse values to a meters/second value and resolved along the orthogonal axes of the unit (versus the sensor axes).

In a similar manner, processes 162 and 164 address the $Y_{accel}$ and the $Z_{accel}$ inputs.

In a manner analogous to the processing of the acceleration information, the Z axis rate-of-turn information is addressed in process 166. The $Z_{rate}$ value, i.e., a hardware-provided analog voltage that is proportional to the turn rate about the Z axis, is input to a low-pass filter 168. The filtered voltage is then supplied to a voltage-to-frequency converter 170 that outputs a pulse stream, the frequency of which is proportional to input voltage (and the sensed rate-of-turn information). The pulse stream is then summed in an accumulator 172 over recurring fixed count periods. The output of the accumulator 172 is then gated and reset at 174 (the pulse count is proportional to integrated voltage, i.e., the rotation increment) and provided to the scale factor/units conversion function block 160 that changes the gated pulse values to a radians/second value resolved along the orthogonal axes of the unit.

As represented by the two null (i.e., zero) channels inputting to the scale factor/units conversion function block 160, turn rates corresponding to pitch and roll are zero, since the locomotive is confined to a trackway and pitch/roll values are negligible.

The output of the scale factor/units conversion function block 160 is subject to the removal of known or estimated sensor errors/biases at point 176 with this error-corrected value provided to the functional block 178 that effects a digital integration of the nonlinear motion equations associated with strapdown navigation systems using information from an appropriately selected gravity and spheroid model, such as the WGS-84 dataset.

The output of the functional block 178 is periodically gated at 182 and, thereafter, various estimated velocity, position, and alignment errors are removed at point 184; the output being the error-compensated strapdown solution for the various inputs.

The process of FIG. 6 uses the strapdown velocity solution of FIG. 5 and includes two additional principal processes, the mainline track 186/turnout track 188 and the locomotive projection solution.

As shown in FIG. 6, the velocity vector solution from FIG. 5 is provided to a track projection block 190 (of the process 186) and to a project along the locomotive axis block 192. The projection block 190 also receives an input from the track profile functional block 194 from which estimated profile parameters errors are removed at point 196. The output of the projection block 190 (representative of the along-track and cross-track velocities) is subject to an integration in block 198 to, in turn, output along-track and cross-track displacements. Estimated along-track distance errors are removed from the output of block 198 at point 200 such that process 186 outputs the error-corrected along-track distance, cross-track displacements, and cross-track velocities from the main track solution.

The turnout track solution process 188 is similarly configured.

As shown in the lower part of FIG. 6, the along-track and cross-track velocities from functional block 190 are output to a signal averaging block 202 which also accepts the outputs of functional block 192 to output direction of travel and along-track speed.

The functional block 192 also accepts the nominal installation alignment values from block 204 and estimated mounting alignment errors are removed at point 206. The output of the functional block 192 is subject to integration at 208 to output the locomotive longitudinal distance and lateral displacement with corresponding errors removed at 210.

Figure 7:
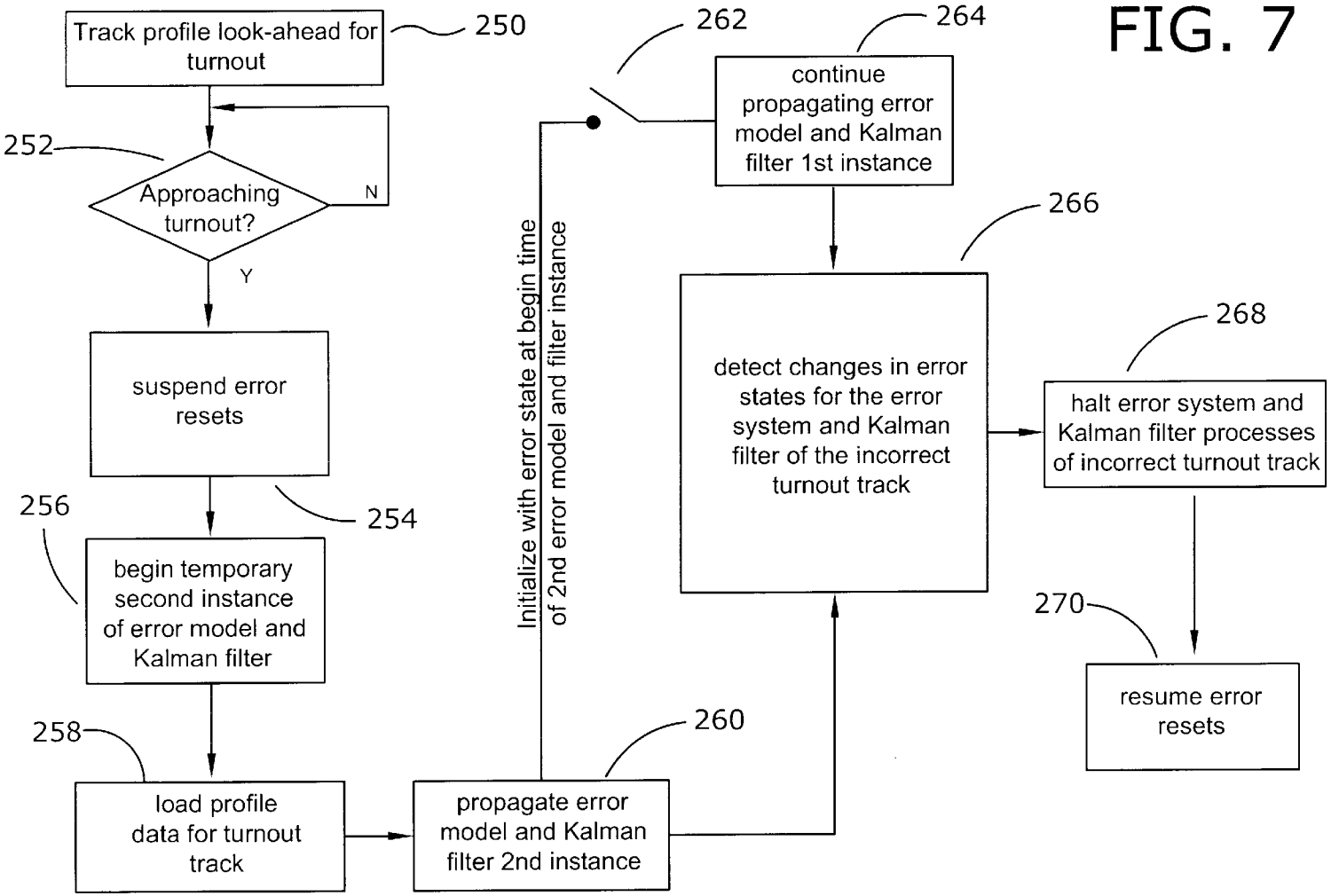
FIG. 7 is an overall process flow diagram of the solution of track occupancy at a turnout.
Figure 8:
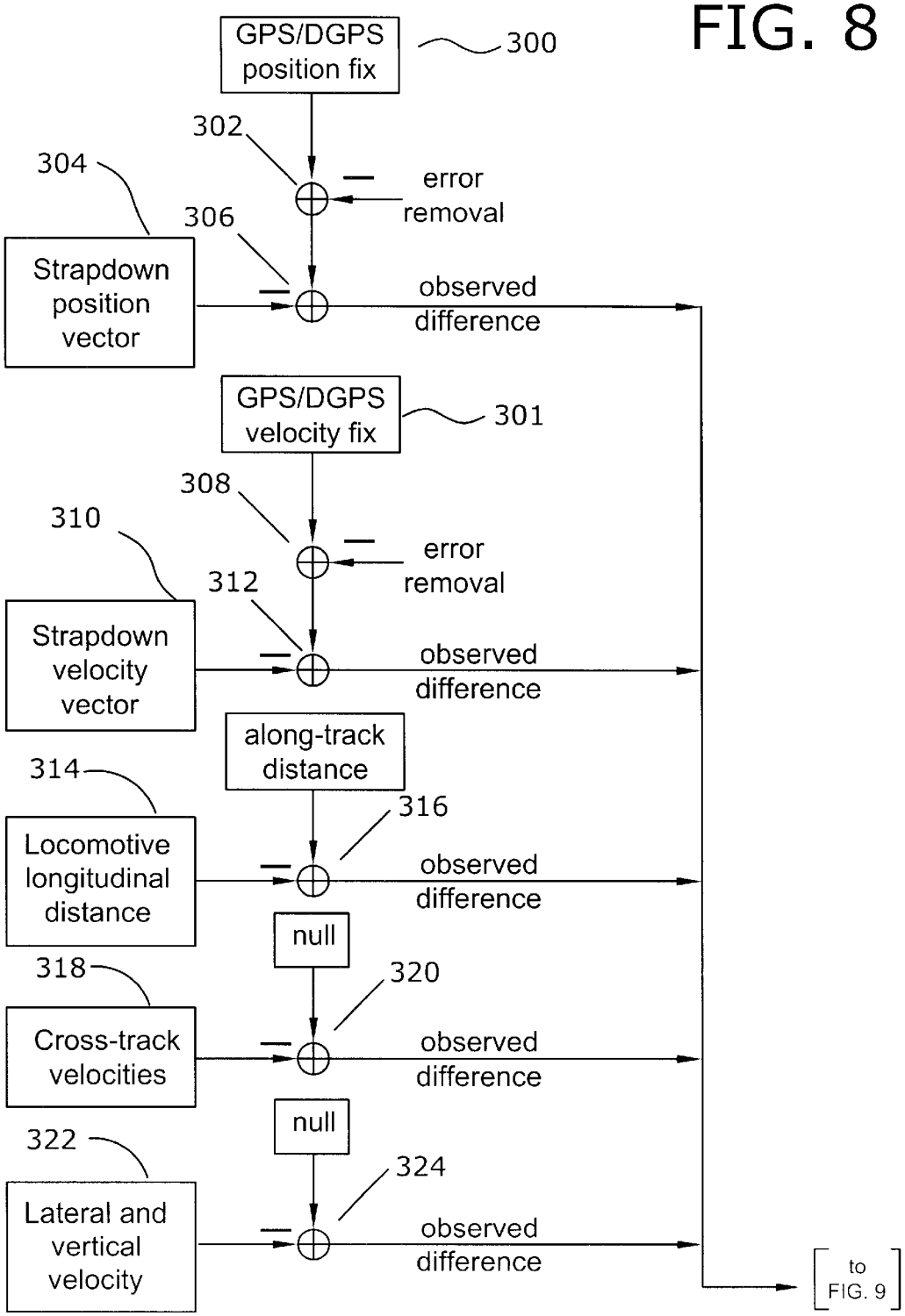

The location determination system 10 addresses the turnout track determination problem, as shown in FIG. 7, 8, and 9, by using fault detection concepts to compute solutions for each of the two diverging tracks at a turnout or branch point. The solution forced to propagate along the incorrect track eventually yields step- and ramp-wise changes in estimated error states. The presence of these changes drives the correct solution of the track-occupancy-at-diverging-tracks problem quickly and with a high degree of confidence.

As shown in the overall process diagram of FIG. 7, the impending turnout is determined by a look-ahead functional block 250. A query is presented at decision point 252 as to the whether or not a turnout is being approached, and, if no, the process flow loops. If a turnout is being approached, the optimal estimator error resets are suspended at block 254. A "second instance" optimal estimator is initiated at block 256 and the turnout track data profile is loaded at block 258. Thereafter, the second instance error propagation proceeds in functional block 260 after initialization via initialization event command 262. Functional blocks 264 and 266 effect continuing processes while checking for the presence of changes in estimated sensor error mechanisms. The presence of these changes indicates a 'wrong track' outcome (thus determining the correct track). Thereafter, 'wrong track' optimal filter sequence is halted at functional block 268 and normal (non-turnout problem) error resets are resumed at functional block 270.

FIGS. 8 and 9 illustrates measurement differences for all measurements sources utilized. As shown in FIG. 8, the GPS/DGPS position fix block 300 is subject to error removal at point 302 and then differenced with the inertial (i.e., strapdown) position vector 304 at point 306 to provided an observed difference. In a similar manner, the GPS/DGPS velocity fix block 301 is again subject to error removal at point 308 and then differenced with the inertial (i.e., strapdown) velocity vector 310 at point 312 to provided a corresponding observed difference. Similarly, the locomotive longitudinal distance value of block 314 is differenced with the track profile-based along-track distance value at point 316, the cross-track velocities of block 318 are differenced with a null value at point 320, and the lateral and vertical velocity of block 322 are differenced with a null value at point 324 to provide corresponding observed differences. It is noted that differencing with a null value is justified in the case of function blocks 314, 318, and 322 since the average value is at or near mean-zero. These "pseudo-measurements" are used to effect the physical constraints of the locomotive's motion.

The observed difference values of FIG. 8 are provided to FIG. 9 for combination with other observed differences. More specifically and as shown in FIG. 9, tachometer wheel radius (which may also include a scale factor) is differenced with wheel radius error information in block 328 at point 330 and, in turn, multiplied with the tachometer wheel rotation rate in block 332 at point 334 with the output differenced with the averaged along track speed in block 336 at point 338 to provide the corresponding observed difference.

The GPS/DGPS-obtained speed over ground value in block 340 is difference with the averaged along-track speed at point 344 to provide an observed difference. Lastly and in a similar manner, the track profile parameters of block 346 are combined with the along track distance of block 348 to compute the locomotive orientation relative to Earth in function block 350 with that value differenced with the inertially derived alignment matrix in block 353 at point 354 to provide the corresponding observed difference.

Summing junctions 316, 320, 326, and 354 effect geo-reconciliation when processed by the Kalman filter. Junctions 320 and 324 also effect the physical constraints on the locomotive's motion.

Figure 10:
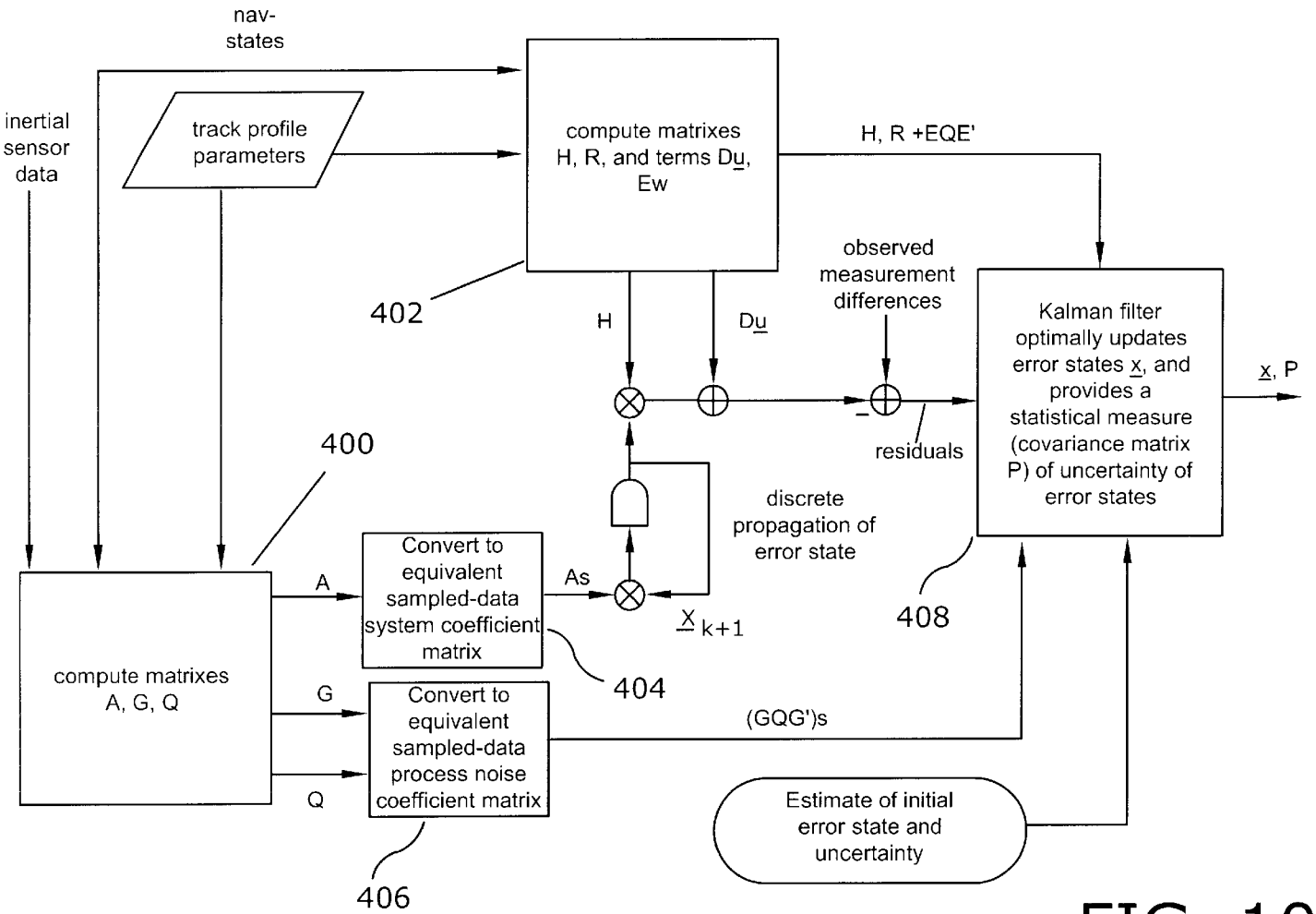
FIG. 10 is an error model for the track occupancy at a turnout solution.

FIG. 10 illustrates the various parameter matrices used to synthesize the error model as required by the Kalman filter and for the approach to a turnout solution including functional block 400 that computes a continuous-time error model system coefficient matrix A, process noise influence matrix G, and model truncation/process noise covariance matrix Q and functional block 402 that computes an output sensitivity matrix H, direct transmission term $D\underline{u}$, model truncation/process noise influence term $E\underline{w}$, and measurement uncertainty matrix R.

The error model states for functional block 400 include strapdown-computed position, velocity, and alignment errors, the locomotive longitudinal distance error, the along-track distance error, the inertial sensor bias and scale factor errors, the locomotive cab mount installation misalignment, the locomotive cab sway, the GPS/DGPS position and velocity fix errors, the tachometer scale factor error, and the track profile longitude, latitude, grade, superelevation, and heading parameter errors. The process noise statistics for function block 400 include inertial sensor bias and scale factor stability, and broadband noise, track profile parameter error influence on locomotive longitudinal distance error calculation, track profile parameter error influence on along-track distance error calculation, cab mount vibration, cab sway and effects due to neglected suspension characteristics and unmodeled motions/misalignments, GPS/DGPS position and velocity fix drift characteristics, and tachometer scale factor degradation.

The measurement error model of function block 402 includes difference between GPS/DGPS position and velocity vectors and strapdown position and velocity vectors, the difference between along-track distance and loco-longitudinal distance, the deviation of cross-track velocity from null, the deviation of lateral velocity from null, the difference between tachometer-based speed measurement and computed average along-track speed, the difference between GPS/DGPS speed-over-ground measurement and computed along-track speed, and the difference between strapdown and track resolved alignment matrix.

The measurement error statistics for the function block 402 includes GPS/DGPS receiver position and velocity fix uncertainties, GPS/DGPS speed-over-ground uncertainty, tachometer resolution and noise characteristics, the along-track minus loco-longitudinal distance difference tolerance, cross-track velocity tolerance, the lateral and vertical velocity tolerance, and the strapdown minus track resolved alignment matrix difference tolerance.

The output of the function block 400 is provided to converting blocks 404 and 406 with the converted output of block 406 provided to the optimal (Kalman) estimator 408 and the output of the block 404 processed with that of the block 402 prior to inputting into the optimal estimator 408.

The present invention incorporates the concept of geo-reconciliation, a method by which desired variables are continually corrected by computing repeatedly using models ith complimentary error characteristics.

In the context of computing velocity and position vectors, for example, the strapdown navigation solution is subject to low frequency bias and random walk errors typical of inertial sensors. Such errors grow in an unbounded manner upon integrating accelerometer and gyro output signals to obtain velocity and position, i.e., the computation has poor long-term stability. Conventionally, these long-term errors are corrected by blending with (e.g., in a Kalman filter) GPS data which possess comparatively excellent long-term stability. Also, and conversely, the strapdown solution possesses good short-term stability, as the integration process tends to smooth high-frequency sensor errors (which are usually attenuated significantly by low-pass filtering), while GPS data has comparatively poor short-term stability due to multi-path effects, broadband noise, etc.

The present invention uses the above approach, but due to the inevitable loss of the GPS data, also seeks additional data sources that possess long-term stability and can be blended in a similar manner.

These additional data sources are provided by the projection and subsequent integration of the velocity vector along both the track profile (reference axes aligned with the track centerline and moving with the locomotive), and Locomotive-fixed reference axes. The term geo-reconciliation is used herein because both of these data and subsequent calculations involve various geometric parameters, e.g., the orientation of the reference axes aligned with the tack profile is defined in terms of latitude, longitude, grade, superelevation, and heading, and the orientation of locomotive-fixed reference axes is given by a constant mounting misalignment matrix with respect to the device.

As these data sources are analytic in nature, their availability for blending is essentially continuous, in contrast, for example, with GPS position ix data where typically only a single data point is available each second and only when sufficient satellites are visible to compute a fix.

As will be apparent to those skilled in the art, various changes and modifications may be made to the illustrated train location system and method of the present invention without departing from the spirit and scope of the invention as determined in the appended claims and their legal equivalent.

What is claimed is:

1. A train location system for locating the position of a train on a track upon passage by the train through a turnout having at least the first and the second track leading therefrom, comprising:

an inertial sensor system sensing linear and rotary acceleration associated with the movement of the rain over the track;

a sensor for determining, either directly or indirectly, distanced traveled over the tracks;

a radio-frequency based geo-positional receiver for at least periodically determining a geo-positional value for the train; and an optimal estimator for accepting information on a continuous or periodic basis from the inertial sensor system, the distanced traveled sensor, and the geo-positional receiver and establishing within said optimal estimator a first computational instance for the first track and a second computational instance for the second track using predetermined track parameters, the optimal estimator computing location and respective estimated error states for each of the first and second computational instances until one of the first and second computational instances exhibits step-wise and ramp-wise changes in its estimated error states to indicate that the track for that instance is not the track occupied by the train.

2. The train location system of claim 1, further comprising the step of:

ceasing the computational instance that exhibits step-wise and ramp-wise changes in its estimated error states indicating that the track for that instance is not the track occupied by the train.

3. The train location system of claim 1, wherein said inertial sensor system provides X, Y, and Z acceleration values and a Z turn rate value.

4. The train location system of claim 3, wherein said output of the inertial sensor system is subject to gravity model and/or sphereoid constraint correction.

5. The train location system of claim 1, wherein said distance traveled sensor comprises a wheel tachometer.

6. A method of determining track occupancy of a train after the train has passed through a turnout onto either of a first or at least a second track, comprising the steps of:

inertially sensing linear and rotary acceleration associated with the movement of the train over the track;

determining, either directly or indirectly, distanced traveled over the tracks;

establishing, in an optimal estimator, a first computational instance for the first track and a second computational instance for the second track using predetermined track parameters, processing, in the optimal estimator, each of the first and second instances to compute at least the location of the train and/or values related thereto by derivation or integration and respective estimated error states until one of the first and second computational instances exhibits step-wise and ramp-wise changes in its estimated error states indicating that the track for that instance is not the track occupied by the train.

7. The method of claim 6, further comprising the step of:

ceasing the computational instance that exhibit step-wise and ramp-wise changes in its estimated error states indicating that track for that instance is not the track occupied by the train.

8. A locomotive location system for locating the position of the locomotive on a track upon passage by the locomotive through a turnout having at least a first and a second track leading therefrom, comprising:

a strapdown inertial navigation system for providing at least linear and rotary acceleration associated with the movement of a locomotive over the track and at least a first integral thereof;

a sensor for determining, either directly or indirectly, distanced traveled along the tracks;

an optimal estimator for accepting information on a continuous or periodic basis from the strapdown inertial navigation system, the distanced traveled along the track sensor and establishing a first computational instance for the first track and a second computational instance for the second track using predetermined track parameters, the optimal estimator computing location and respective estimated error states for each of the first and second computational instances until one of the first and second computational instances exhibits step-wise and ramp-wise changes features in its estimated error states indicating that the track for that instance is not the track occupied by the locomotive; and a radio-frequency based geo-positional receiver for at least periodically determining a geo-positional value for the locomotive.

9. The locomotive location system of claim 8, further comprising the step of:

halting the computational instance that exhibit step-wise and ramp-wise changes in its estimated error states indicating that the track for that instance is not the track occupied by the locomotive.

* * * * *